United States Patent [19]

Oka et al.

[11] Patent Number: 4,745,437

[45] Date of Patent: May 17, 1988

[54] COPIER MACHINES

[75] Inventors: Tateki Oka, Toyokawa; Naoki Toyoshi, Toyohashi; Tomoaki Yokoyama, Toyokawa, all of Japan

[73] Assignee: Minolta Camera Kabushiki Kaisha, Osaka, Japan

[21] Appl. No.: 71,263

[22] Filed: Jul. 8, 1987

[30] Foreign Application Priority Data

Jul. 15, 1986 [JP] Japan ..... 61-167342
Jul. 15, 1986 [JP] Japan ..... 61-167343

[51] Int. Cl.[4] ..... G03G 15/00

[52] U.S. Cl. ..... 355/14 CH; 355/3 CH; 355/14 R; 355/14 D

[58] Field of Search ..... 355/3 CH, 3 R, 7, 14 R, 355/14 CH, 14 D

[56] References Cited

U.S. PATENT DOCUMENTS 3,967,891 7/1976 Rippstein .
4,346,982 8/1982 Nakajima et al. ..... 355/3 R
4,480,909 11/1984 Tsuchiya ..... 355/14 CH
4,618,249 10/1986 Minor ..... 355/14 CH
4,636,060 1/1987 De Schamphelaere et al. ..... 355/14 CH

FOREIGN PATENT DOCUMENTS 51-134635 11/1976 Japan .
54-30833 3/1979 Japan .

*Primary Examiner*—A. C. Prescott
*Attorney, Agent, or Firm*—Wenderoth, Lind & Ponack

[57] ABSTRACT

The copier machine of the present invention comprises a second charger having a grid and is capable of executing a mode wherein a toner is deposited onto the latent image exclusive of the outline portion thereof to visualize.

When this mode is designated, the grid is applied with the voltage which is lower than the surface potential at the image portion of the latent image and higher than the surface potential at the non-image portion of the latent image.

15 Claims, 8 Drawing Sheets

COPIER MACHINES

BACKGROUND OF THE INVENTION

1. Field of the Invention

This invention relates generally to electronic photocopier machines, and more specifically, it relates to copier machines which can operate in such a operation mode as to form negative peripheral outline images by depositing the toner onto portions than peripheral outlines of those corresponding to original documentary images.

2. Description of the Prior Arts

Generally speaking peripheral outlines of image or images are most full of necessary informations of the images, thus playing an important and characterizing role for showing of true and necessary features of the images under consideration.

Further, when peripheral outlines are taken out from normal and generalized images and processed into binary-graphed one, identification and the like various services of the original images can be rather easily, promptly and sharply executed than in the case of variable concentration method, and for the purpose of pattern recognition, feature stressing or the like.

As a further example, in such a case where twice copying jobs are executed, so as to provide a black pattern image is firstly provided and then a peripheral color outline is formed along the black pattern for providing a complex and attractive effect.

As a further example, a pattern is colored differently and dividingly for providing a complex color design effect. In this case, use of the present invention is highly convenient and advantageous.

It should be mentioned in this respect that we filed already our prior inventions under U.S. patent application Nos. 016,716 and 016,717, commonly Feb. 19, 1987, proposing to form positive peripheral outline images from corresponding documentary positive images.

As a still further improving step, we have now completed a still novel invention thereover and concerning the formation of peripheral outline images to such an amazing effect, indeed, to form from positive documentary images, corresponding negative peripheral outline images.

SUMMARY OF THE INVENTION

An object of the present invention is to provide an electronic photocopier machine capable of forming sharp and distinct peripheral outline images and without accompanying excess and foggy deposition of the toner used.

A further object is to provide a visualized images other than the peripheral outline images of corresponding documentary images, by properly depositing the toner.

A still another object of the invention is to provide such an electro-photocopier machine as being capable of selective operation between a first operating mode for providing a visualized images other than the peripheral images of corresponding documentary images by properly depositing the toner, and a second and standard operating mode.

A still further object of the invention is to provide an improved electronic photocopier machine, capable of selective operation of the first mode set forth above, a second mode of operation for providing visualized images by depositing the toner exclusively onto the peripheral outline images of corresponding documentary images, and a third and standard operation mode.

These and further objects, features and merits of the invention can be fulfiled by providing such an electronic photocopier machine, comprising in combination of:

(1) a first charger for impressing a static charge at a substantially predetermined level on static latent image carriable means at its surface;

(2) image exposure means for exposure of documentary images on the surface of said static latent image carriable means precharged in the manner as above;

(3) a second charger having a grid for recharging said static latent images formed under the operation of said image exposure means;

(4) developing means for developing said static latent images formed on the surface of said latent image carrying means by use of an insulative toner having a polarity in opposition to the charge prevailing at said first charger;

(5) a first operation mode specifying means for allowing to deposit the toner onto said static latent images, however, devoid of peripheral outlines thereof, and for visualization; and (6) means for control to bring said second charger into operation, when said first operation mode has been specified.

BRIEF DESCRIPTION OF THE DRAWINGS

In the following description, like parts are designated by like reference numbers throughout the several drawings.

PREFERRED EMBODIMENTS OF THE INVENTION

Referring now to the accompanying drawings, several preferred embodiments of the invention will be illustrated more specifically.

Figure 1:
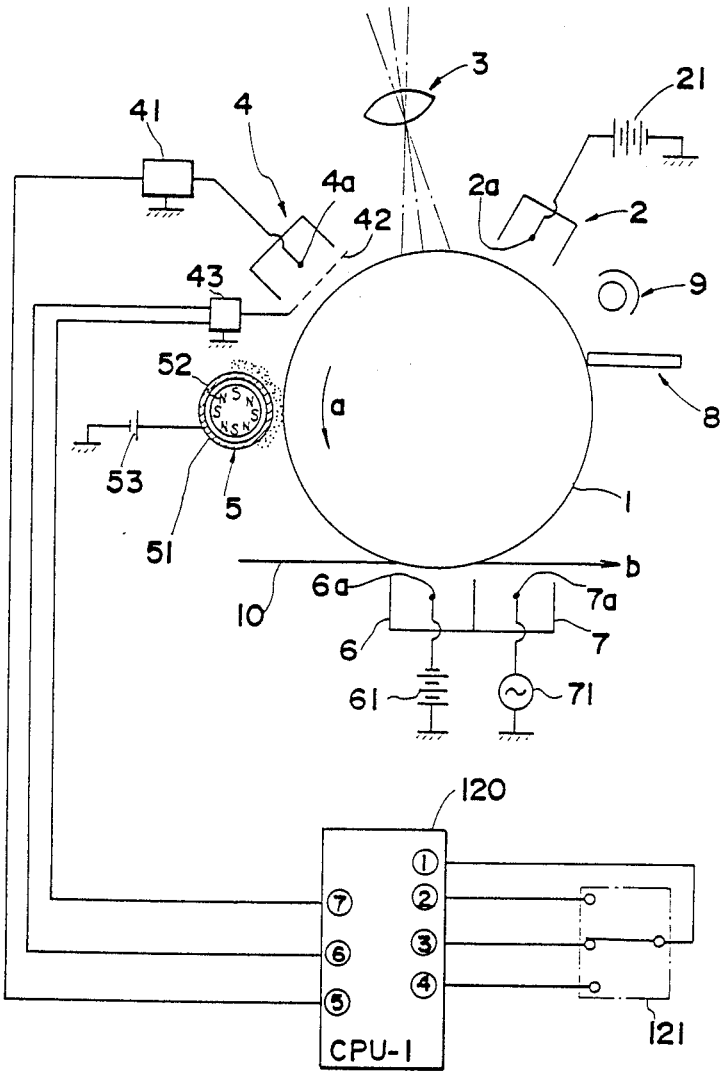
FIG. 1 is a schematic substantially elevational view of essential parts of a first embodiment of the inventive photocopier machine.

In FIG. 1, essential parts of the first embodiment of the inventive electronic photocoping machine are shown only schematically and substantially in elevation.

Numeral 1 represents a photosensitive drum having an outer layer thereof, made of photosensitive material although not specifically shown on account of its very popularity; said drum being mounted rotatably as hinted by a curved arrow a.

Around the drum 1, several members and units are provided for cooperation therewith.

Numeral 2 represents a static charger which acts to execute the first charging step for apply a static charge at a predetermined constant level onto the surface of drum 1, the charge wire of said static charger being electrically connected with a voltage source 21.

Numeral 3 represents an exposure unit which representatively shown by a condenser lens, said unit comprising further an exposure lamp and a reflecting mirror, although not shown by virtue of very popularity and on account of drawing facility, said exposure unit being adapted for forming static latent images of those on the document, not shown, in the conventional slit exposure principles in an corresponding manner.

Numeral 4 represents a scorotron charger which acts to execute a second charging onto the drum surface 1 which has already been formed with static latent images under the action of the exposure unit 3 as in the above manner. Charge wire 4*a* of the charger 4 is electrically connected with a voltage source 41, while grid 42 attributed to charger 4 is electrically connected with another voltage source 43. Charge wire 4*a* is impressed with an alternating voltage from the source 41, while grid 42 is impressed with a voltage from the source 43 with a voltage which is of the same polarity as that appearing at static charger 2 and lower than the surface potential at the static latent image areas and higher than the surface potential at the non-image areas. On/off of scorotron charger 4 and voltage value impressed upon grid 42 are controlled in change-over manner and in the following manner to be set forth.

Developing unit 5 operates in the conventional magnetic brushing mode and fitted with a developing sleeve 51 which is fitted insidely with a magnet roller 52 having peripherally arranged N- and S-pole segments. To the developing sleeve 51 which is functionable also as developing electrode, is connected electrically a developing bias voltage source 53.

The developing agent consists of a mixture of magnetic carrier and insulative toner, these two components being mutually oppositely charged through the way of friction charging and the insulative toner being charged of the opposite polarity to that prevailing at static charger 2. Developing sleeve 51 charged from voltage source 53 with a developing bias voltage of the same polarity prevailing at the static charger 2.

Numeral 6 represents a transfer charger, which applies a copy paper 10 being carried along in the direction as shown by an elongate arrow an electric field from rear side of the copy paper, for execution a transfer job to transfer the tonered images on the drum surface 1 onto the paper under the action of developing unit 5. Charge wire 6*a* of the transfer charger 6 is charged from voltage source 61 with a voltage having opposite polarity to that prevailing at the insulative toner.

Numeral 7 represents a separation charger, which is provided with a charge wire 7*a* impressed with an alternating voltage from voltage source 71, thus being adapted applying an alternating electric field to the copy paper directly after the foregoing image transfer step.

Numeral 8 represents a cleaner in the form of a contacting blade for removal of excess and residual toner from the drum surface in the manner of the conventional separation blade mode.

Numeral 9 represents an eraser which adapted for erasing residual charges from the drum surface and through light projection therefrom, for making ready for the next following copying service.

Figure 2:
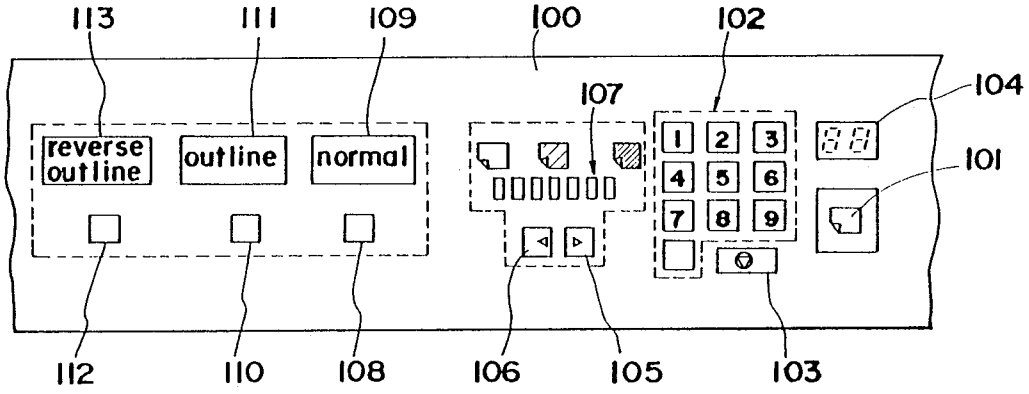
FIG. 2 is a schematic top plan view of an operation control panel employed therein.

In FIG. 2, an operation control panel 100 mounted on the housing, not shown, on the present photocopier machine is schematically shown, although the specific mounting mode and place have been omitted on account of very popularity. On this control panel 100, several keys, display means and the like are provided.

More specifically, 101 represents a print key; 102 ten keys; 103 a clear/stop key; 104 a display showing number of copied sheets and the like; 105 and 106 up/down keys for control of image intensity; 107 a display thereof consisting of LED2; 108 a standard copy mode preselection key; 109 a display lamp therefor; 110 a peripheral image outline formation mode preselection key; 111 a display lamp therefor; 112 a reverse peripheral image outline formation mode preselection key; and 113 a display lamp therefor.

Control operations are carried out through a microcomputer 120, shown in FIG. 1, as a control center. On/off operations of mode selection keys 108; 110 and 112 are converted into on/off signals at change-over switch means 121, although the electric conductors therefor having been omitted from the drawings only for reason of simplicity of the drawing, said on/off signals are then fed, through inlet terminals (1)–(4) of the computer 120, into the latter. An output terminal (5) is electrically connected to voltage source 41 of scorotron charger 4 for on/off control thereof. Output terminals (6) and (7) are electrically connected with grid voltage source 43 of scorotron charger 4, and more specifically, terminal (6) is used for on/off control of the source 43 and terminal (7) serves for output voltage level of the same source 43.

Operations of change-over switch means 121; output signals from computer 120; polarities and voltage levels of several chargers and the like under control with these output signals will be enlisted in the following Table I.

TABLE I

| | Standard copy mode | Peripheral outline Formation mode | Reverse peripheral outline formation mode |
|---|---|---|---|
| Change-over switch 121 | Terminals (1)–(2) conducting | Terminals (1)–(2), conducting | Terminals (1)–(4), conducting |
| Output from terminal (5) ON/OFF of source 41 | OFF | ON | ON |
| Output from terminal (6) ON/OFF from source 43 | OFF | ON | ON |

TABLE I-continued

| | Standard copy mode | Peripheral outline Formation mode | Reverse peripheral outline formation mode |
|---|---|---|---|
| Output from terminal (7) H/L of voltage at source 43 | — | L | H |
| Charger (source 21) | +5.5 kV | +5.5 kV | +5.5 kV |
| Scorotron charger (source 41) | — | AC ±6.0 Kv | AC ±6.0 kV |
| Grid (source 43) | — | +200 V | +500 V |
| Developing bias (source 53) | +300 V | +300 V | +300 V |
| Transfer charger (source 61) | +5.5 kV | +5.5 kV | +5.5 kV |
| insulative toner | negative | negative | negative |

As an alternative measure, all the polarities enlisted herein above may be reversed at one chance. It should be noted that the foregoing voltage values are raised only for examples and thus not limitative.

Image formation progresses with use of the foregoing photocopier machine, will be set hereinbelow in operation-modewise and stepwise: It should be mentioned that the original document used are positive one, so far as the present first embodiment is concerned.

(Standard Copy Mode)

In the present mode of operation, the original documentary images are processed into corresponding copy images in 1:1 as conventionally and will be executed by operating the selection key 108, so as to make terminals, (1);(2) of change-over switch 121 conducting. In this case, voltage source 41;43 are kept OFF for keeping scorotron charger 4 OFF. At the same time, display lamp 109 is ignited.

(i) First charging step:

Under the action of charger 2, the drum surface 1 is charged with a predetermined level of potential. As the result, the drum surface potential amounts to +600 V.

Figure 4A:
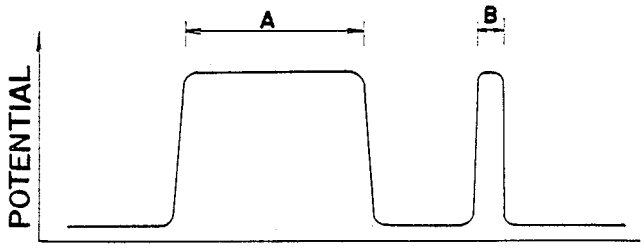
FIG. 4 is a schematic graph for showing potentials of the formed static latent images appearing a several steps when the above operation mode has been selected out.
Figure 4B:
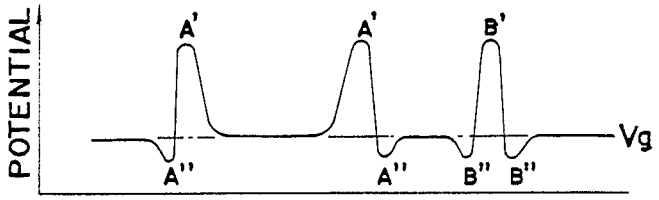
Figure 4C:
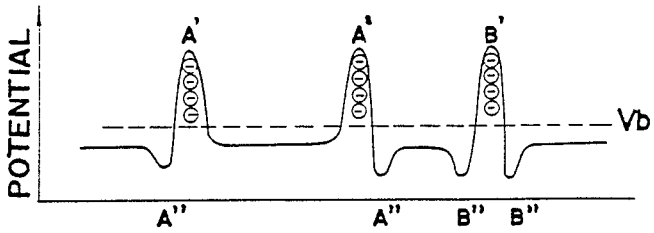

(ii) Exposure step:

Next, documentary positive images are slit-exposed on the drum surface previously charged to +600 V, so as to form corresponding latent images thereon. In this case, as shown in FIG. 4 at (a), the level of static charge corresponding to image portions A and B shown as a representative and schematic example remains at the potential of +600 V, while the charge existing at the parts which corresponding to non-image areas lowers to +100 V or so by the exposure of light executed in the present step.

(iii) Second charging step:

Voltage sources 41 and 43 are made to OFF, and thus the scorotron charger 4 is held out of service, and the present step is dispensed with. Therefore, the positive latent images formed in the foregoing exposure step are as per se carried forward to the next succeeding developing step.

(iv) Developing step:

The latent positive images formed in the foregoing exposure step are subjected to deposition at the developing unit 5. At this stage, developing stage 51 is impressed with a developing bias voltage of +300 V. In this case, negatively charged insulative toner deposits on the image portions A and B shown in FIG. 4 at (a) so that normal tonered images corresponding to the documentary images 1:1 so to speak are formed in the normal developing mode.

Then, the tonered images will be transferred onto the copy paper through positive discharge at transfer charger 6 and fed further to a conventional fixing unit, not shown, for providing copy images.

(Peripheral Outline Image Formation Mode)

In this mode, peripheral outlines only of positive documentary images devoid of substantial effective areas thereof are formed into corresponding positive one. For this purpose, corresponding selection key 110 is manipulated, so as to make terminals 1 and 3 of change-over switch means 121 conductive. In this case, sources 41 and 43 are made ON for energizing scorotron charger and for bringing terminal 7 to "L", so as to feed grid voltage source 43 with +200 V. At the same time, display lamp 111 is ignited.

(i) First charging step:

Operations are same as with those adopted in the foregoing standard copy mode.

(ii) Exposure step:

Positive documentary images are slit-exposured onto the drum surface 1 which has been precharged to +600 V potential, for the formation of corresponding positive latent images. In this case, as shown schematically and representatively in FIG. 4 at (a), the static charge at the corresponding portions to image areas A and B remains at +600 V, while the charge at such portions as corresponding to non-image areas will be lowered to −100 V or so through the light exposure.

(iii) Second charging step:

Drum surface 1 on which positive latent images has been formed in the foregoing manner, is subjected to a recharging step under the action of scorotron charger 4 impressed with an alternating voltage of ±6.0 kV. At this stage, grid 42 is impressed from the source 43 with a voltage of +200 V. This impressing voltage on the grid 42 is substantially lower than surface potential, +600 V, residing at static latent image portions, only representatively and schematically shown at A and B, and, however, somewhat higher than the surface potential residing at non-image portions, or +100 V.

Figure 3:
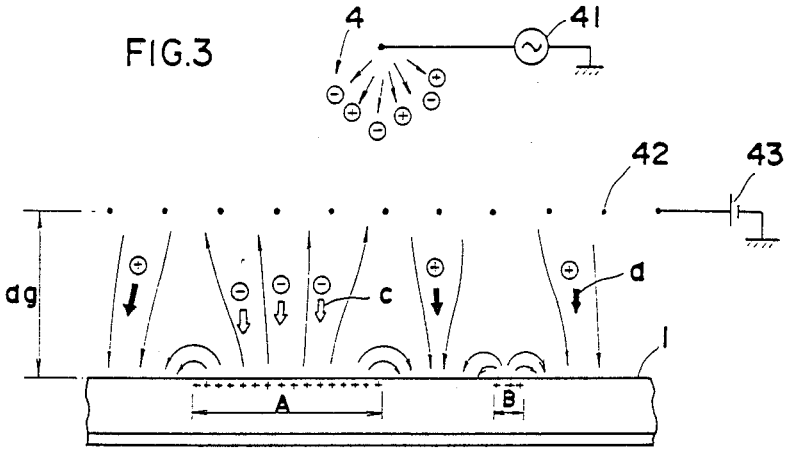
FIG. 3 is a schematic explanatory graph for showing generation of electric lines of force at the second charging step when the peripheral outline image forming mode has been specified.

Electric lines of force shown only schematically in FIG. 3 by elongated arrows are formed between drum surface 1 and grid 42, and negative and thus positive ions emanating from charge wire **4*a* are subjected to carrying drive forces along these electric lines of force. As seen, those electric lines of force which drive negative ions in proximity of grid 42 towards drum surface 1 are generated only with relation to substantial and effective part of areal image portion representatively shown at A, however being devoid of inside peripheral zones A′ thereof. Thus, the negative ions will impinge upon said substantial and effective part of areal image portion A, as shown schematically by double-lined arrows c in FIG. 3**, thereby electrical charge at the ion-impinged part being subjected to a removal of charge and a reduction of potential level to such that which is substantially, equal to the grid voltage Vg.

On the other hand, the positive ions will impinge upon substantial parts of non-image, however, being devoid of outside zones A″, B″ of peripheral outlines of imaged portions A; B, as schematically shown by thickened arrows d in FIG. 3, thereby the potential level of the ion-impinged areas being subjected to a somewhat rise up to that substantially equal to the grid voltage.

More specifically illustrating in terms of drum surface potentials, and as shown in FIG. 4 at (b), inside peripheral zones A′; B′, having a certain constant width, of peripheral outlines of imaged portions A; B are held at a high potential level, substantially equal to +600 V, while outside peripheral zones A"; B" of peripheral outlines of imaged portions A; B remains partly at a low potential level substantially equal to ±100 V or so and the potentials at non-image devoid of peripheral outside zones A"; B" situating outside of peripheral outlines of imaged portions A; B will be subjected to a certain rise up substantially to the grid voltage (Vg:+200 V) or so. At the same time, the potential at substantial and effective part of areal image portion A will be lowered to the grid voltage level. As for the linear image portion B, the surface potential will show almost no drop in the level, the width of the potential zone will be, however, subjected to a certain reduction under the influence of inside peripheral zones.

In other wirds, during the present second charging step, peripheral outlines of the image portions A; B are provided, indeed, in the form of corresponding positive latent images.

(iv) Developing step:

The static latent images formed in form of positive peripheral outline images are subjected to development under the action of developing unit 5. At this stage, the sleeve 51 is impressed with a developing bias voltage of +300 V. This developing bias voltage has same polarity with that appearing in the first charging step and is somewhat higher than the surface potential, +200 V, residing at substantial and effective part of areal image portion represented at A, for positively preventing excess and disadvantageous deposit of the toner onto said substantial image portion as well as non-image portions.

Upon execution of the present step, the negatively charged insulative toner deposits onto high potential regions of drum surface 1, and as shown in FIG. 14 at (c), which are more specifically, inside peripheral zones A'; B' of areal imaged areas A; B relative to the peripheral outlines thereof. Therefore, positive tonered images are formed through the regular depositing way and in the mode of "from-inside embroidering" manner.

The reason why the grid voltage Vg has been selected to be sufficiently lower than the surface potential (+600 V) at static latent image portions, resides in such that during the second charging step, the surface potential at substantial and effective part of areal image portion A should be sufficiently lowered from the former potential level and further that the surface potential at non-image portions should not be raised too much considerable degree.

(Reverse Peripheral Outline Image Formation MOde)

In the present operation mode, the peripheral outlines of positive documentary images are converted into negatively reversed copy images. For this purpose, selection key 112 is manipulated so as to make terminals (1) and (4) of change-over switch means are made conducting. At this stage, voltage sources 41; 43 are made ON so as to energize scorotron charger 4 to operate and terminal (7) is held at "H" for supplying a voltage of +500 V to grid voltage source 43. At the same time, display lamp 103 is ignited.

(i) First charging step:

Operations are similar to those which were adopted in the foregoing two operation modes.

Figure 5A:
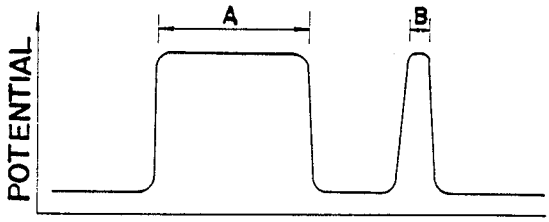
FIG. 5 is a similar view to FIG. 4, when, however, reverse peripheral outline image formation mode has been specified.
Figure 5B:
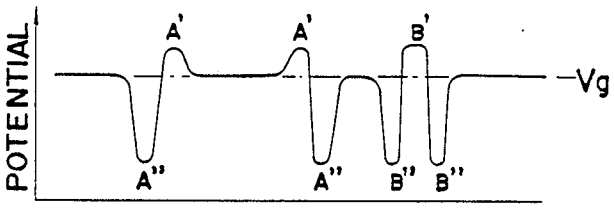
Figure 5C:
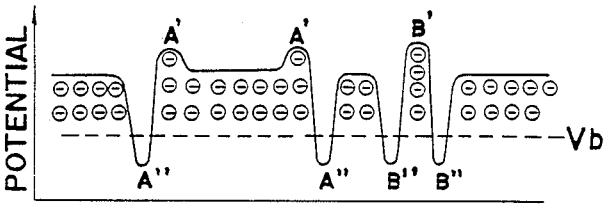

(ii) Exposure step:

Operations are similar to those which were adopted in the foregoing two operation modes. Static latent images formed on drum surface 1 are as shown in FIG. 5 at (a) which are similar to those as was shown in FIG. 4 at (a).

(iii) Second charging step:

The drum surface 1 which has been formed with positive latent image is then subjected to a recharging step under the action of scorotron charger 4 impressed with an alternating voltage of ±6.0 kV supplied from source 41. At this stage, grid 42 is impressed with a voltage: 30 500 V from source 43. The voltage impressed on grid 42 is somewhat lower than the surface potential (+600 V) at static latent image portions A; B and sufficiently higher than surface potential (±100 V) at non-image portions.

Between drum surface 1 and grid 42, electric lines of force are formed, as was shown in FIG. 3 by elongated arrows and in similar way as in the case of peripheral outline image formation mode, and the negative ions emanated from the charge wire will impinge exclusively upon substantial and effective part of areal image portion A as shown by double line arrows c, resulting in certain potential removal thereat and thus, the surface potential lowering to substantially grid voltage Vg or so and to a certain degree. On the other hand, the positive ions will impinge exclusively upon the non-image portions, however, devoid of outside zones of peripheral outlines of imaged portions A; B, as shown by double-lined arrows d, thereby the potential at the areas impinged with positive ions rising up to such a voltage level which is substantially equal to grid voltage Vg or so.

When further describing more specifically in terms of surface potentials on drum 1, inside zones A'; B', along peripheral outlines of imaged portions A; B represent at a constant width high potential level substantially equal to initial surface potential +600 V or so. On the other hand, surface potentials at outside zones A"; B' of peripheral outlines of image portions A; B remain substantially at lower level one amounting to +100 V, while potentials at non-image portions devoid of outside zones A"; B" along peripheral outlines have been subjected to rising up to grid voltage (Vg: +500 V) or so. On the contrary, the potential at substantial and effective part of areal image portion A has been somewhat lowered to the level of grid voltage (Vg: +500 V) or so.

In other words, peripheral outlines of imaged portions A; B have been converted during the second charging step into negatively inverted latent images.

(iv) Developing step:

The static latent images formed as negative images of peripheral outlines during the foregoing second charging step are subjected to a developing action at the developing unit 5. At this stage, developing sleeve 51 is impressed with a developing bias voltage of +300 V as in the similar manner in the foregoing two operation modes. This voltage (Vb) is not only lower than the potentials at inside peripheral zones A'; B; extending along the peripheral outlines of imaged portions A; B, but also lower than those residing at substantial and effective part of areal imaged portion A where the surface potential has been somewhat lowered during the second charging step, as well as lower than the low potential level residing zones A"; B" extending along the peripheral outlines of imaged portions A; B.

Thus, the negatively charged insutative toner will deposit on higher potential portions which correspond to outside zones A"; B" extending along the peripheral outlines of imaged areas A; B, thus the corresponding negative tonered images being formed through the way of normal developing operational mode.

SECOND EMBODIMENT OF THE INVENTION

Figure 6:
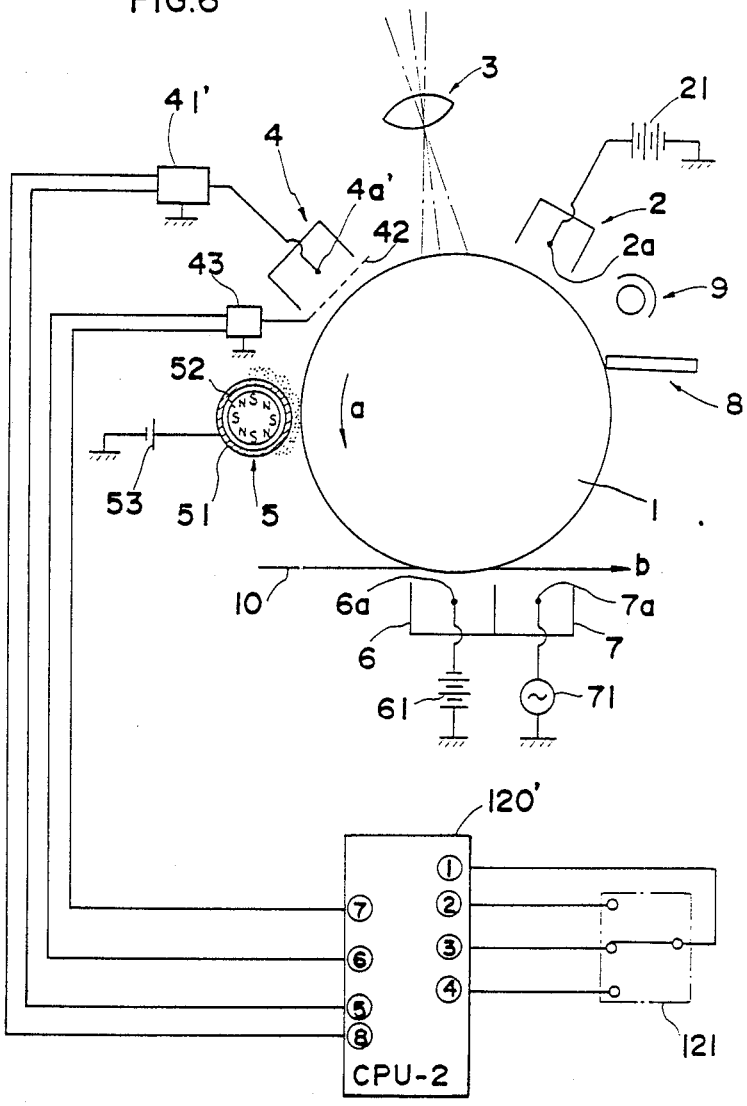
FIG. 6 is a similar view to FIG. 1, showing, however, a second embodiment of the invention.

In the following, a preferred second embodiment of the present invention will be set forth in detail hereinunder:

Main parts and constituents of this embodiment are only schematically shown in FIG. 6 which is substantially similar to the first embodiment shown in FIG. 1.

However, there is certain difference from the foregoing first embodiment, and indeed, as follows:

In the present second embodiment, the voltage impressed on charge wire 4*a*′ from source 41′ can be changed over from d.c.-voltage of same polarity prevailing at the charger 2 to that having opposite polarity and impressed onto the latter, and in the reverse order.

This change-over operation can be controlled through microcomputer 120′ acting as the control center, as in the same manner in the first embodiment. In this case, terminal 8 is connected with source 41′ of scorotron charger 4 for the purpose of polarity of change-over operation control, or more specifically the polarity of voltage which is applied onto charge wire 4*a*′.

Operation of change-over switch 121; output signals from microcomputer 120′ and polarities and impressed voltages at various chargers and the like to be control therewith are enlisted in the following Table II.

TABLE II

| | Standard Copy Mode | Peripheral Outline Formation Mode | Reverse Peripheral Outline Image Formation Mode |
|---|---|---|---|
| Change-over switch 121 | Terminals (1)–(2) conducting | Terminals (1)–(3) conducting | Terminals (1)–(4) conducting |
| Output of terminal (5) ON/OFF of source 41′ | ON | ON | ON |
| Output of terminal (6) ON/OFF of source 43 | OFF | ON | ON |
| Output of terminal (7) Voltage level H/L at Source 43 | — | L | H |
| Charger (source 21) | +5.5 kV | +5.5 kV | +5.5 kV |
| Scorotron charger (source 41′) | — | DC −6.0 kV | DC +6.0 kV |
| Grid (source 43) | — | +200 V | +500 V |
| Developing bias (source 53) | +300 V | +300 V | +300 V |
| Transfer charger (source 61) | +5.5 kV | +5.5 kV | +5.5 kV |
| Insulative toner | negative | negative | negative |
| Output of terminal (8) Polarity at source 41′ | — | negative | positive |

As for the polarities enlisted above, these may be changed to the opposite, if necessary, however, once for all. As for the enlisted numerical values, these are raised only by way of example.

In the following, details for execution of the process with use of the present embodiment will be set forth modewise and stepwise.

(Standard Copy Mode)

In the execution of the standard copy mode, documentary original images are processed in the relation one to one so to speak into corresponding copy images as in the regular way.

For this purpose, selection key 108 is manipulated to service, thereby terminals (1) and (2) of change-over switch means 121 are brought into conduction.

At this stage, sources 41′; 43 are kept OFF, so as to keep scorotron charger 4 in off-service position. At the same time, display lamp 109 is ignited.

Further processing steps are same as in the foregoing first embodiment.

(Peripheral Outline Image Formation Mode)

In the present mode, peripheral outline images of documentary original images are processed into corresponding positive copy images, as in the foregoing first embodiment.

Selection key 110 is manipulated for this purpose, so as to bring terminals (1) and (3) of switch means 121 into conducting state. At this stage, sources 41′; 43 are brought into ON for energizing scorotron charger 4 and terminal (7) is kept at "L" so as to supply grid voltage source 43 with +200 V. At the same time, display lamp 111 is ignited. Control is executed so that the voltage impressed onto charge wire 4*a*′ is of opposite polarity to that prevailing at charger 2, or more specifically to be negative.

(i) First charging step:

Operations are same as in the foregoing standard copy mode.

Figure 8A:
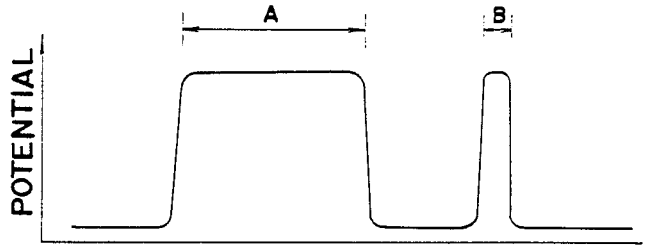
FIG. 8 is a similar view to FIG. 4, however, in the case of the second embodiment.
Figure 8B:
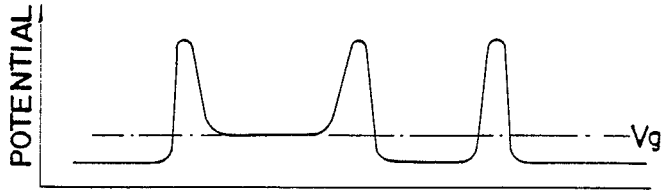
Figure 8C:
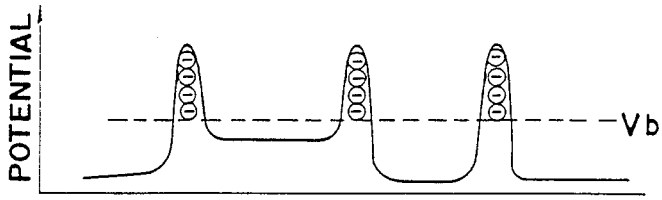

(ii) Exposure step:

Documentary positive images are slit-exposured onto drum surface 1 precharged to the potential level of +600 V, so as to form corresponding positive latent images. In this case, as shown in FIG. 8 at (a), electric charges at corresponding parts to image portions A; B remain at the level of +600 V, while those residing at corresponding parts to non-image areas are subjected to a potential level reduction by the light exposure step to 100 V or so. Additionally to say, the used documentary images are of positive.

(iii) Second charging step:

In this case, scorotron charger 4 applies onto drum surface 1 formed with static latent images in the foregoing step an electric charge of opposite polarity to that of these latent images. At this stage, grid 42 is impressed with a voltage of +200 V. The potential at scorotron charger 4 is of opposite polarity to that which was used in the foregoing first charging step. The voltage impressed on grid 42 is sufficiently lower than the surface potential (+600 V) at static latent images and of same polarity as adopted in the foregoing first charging step. Additionally, the impressed voltage on grid 42 is higher than the surface potential (+100 V) at non-image portions of the latent images.

Figure 7:
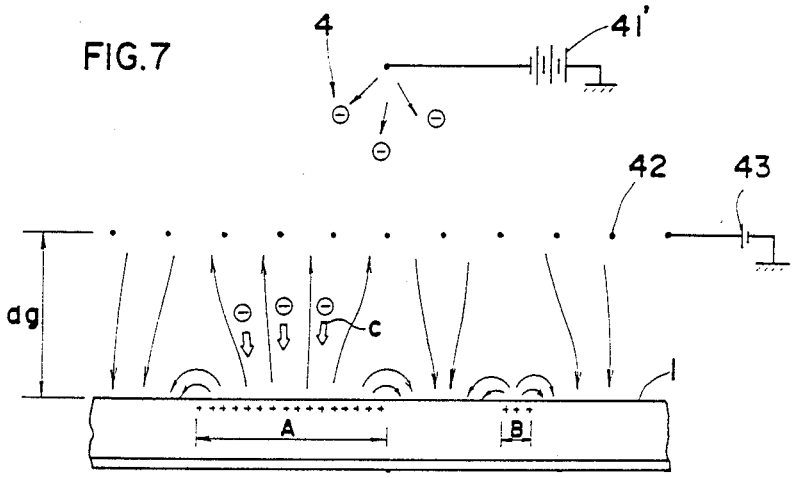
FIG. 7 is a similar view to FIG. 3, however, in the case of the second embodiment.

Between drum surface 1 and grid 42, electric lines of force as shown in FIG. 7 with elongated arrows are formed as before.

Negative ions emanated from charge wire 4*a* are subjected to carrying drive forces along these electric lines of force. In this case, those thereof which drive negative ions in proximity of grid 42 towards drum surface 1 are exclusively generated within the range of substantial part of areal image portion A, however, devoid of inside peripheral zones relative to the peripheral outlines thereof. Thus, the negative ions will impinge exclusively upon said substantial part, thus lowering the potentials at the area(s) impinged with said negative ions, down to such a level as being substantially equal to grid voltage (+200 V) or so.

When further describing more specifically and in terms of surface potentials, as shown in FIG. 8 at (b), surface potential at non-image portions of static latent image area(s) remains at a low potential level of substantially +100 V or so, while inside peripheral zones extending along the peripheral outlines of areal image part A and linear image portion B will remain each with a certain constant width and inform of high potential parts of initial surface potential level substantially equal to +600 V. On the other hand, the surface potential at central part of areal image portion A will be subjected to reduction down to substantially grid voltage Vg: 200 V. At the linear image portion B, there will be no potential drops, the width of the charged area thereof being, however, subjected to reduction.

As a conclusion of the present second charging step, the peripheral outlines of imaged areas A;B are formed into corresponding positive latent images.

(iv) Depositing step:

The positive peripheral outline images of both static latent image areas A;B formed in the foregoing second charging step are subjected to deposition under the action of developing unit 5. Developing sleeve 51 is impressed with a developing bias of +300 V. This developing bias voltage Vb is selected to be somewhat higher than the grid voltage Vg: +200 V and somewhat higher than the potential prevailing at substantial and effective part of areal impage portion A which has been lowered substantially to the level of grid voltage Vg, the polarity being selected to have same polarity with that adopted in the foregoing first charging step, and indeed, for the purpose of positively preventing otherwise possible foggy and disadvantageous deposition of the toner on the said substantial part of the static latent image portions where in the foregoing second charging step the surface potentials have been lowered, as well as non-image portions thereof.

In this way, and specifically shown in FIG. 8 at (c), the negatively charged toner deposits on higher potential portions on the drum surface 1 which mean inside peripheral zones along the peripheral outlines of imaged areas A;B, thereby the corresponding toner images being formed through normal developing operation and in an "from-inside-embroidering" mode so to speak.

The reason why the grid voltage Vg has been set to such a level to be sufficiently lower than the surface potential at static latent image areas resides in such that the surface potential at substantial part of static latent image area(s) should be lowered, in the second charging step, relative to the former surface potential level and further that too much rise up of surface potential at non-image areas should be prevented.

(Reverse Peripheral Outline Image Formation Mode)

In the present operation mode, only the peripheral outline portions of positive documentary images are processed into negatively reversed corresponding copy images, as in the similar way with the foregoing first embodiment.

In this case, selection key 112 is manipulated to make terminals (1) and (4) of change-over switch means 121 conducting. At this stage, voltage sources 41'; 43 are brought to ON so as to energize scorotron charger 4 and the terminal 7 is held at "H" for supply of a voltage of +500 V to grid voltage source 43. At the same time, display lamp 103 is ignited. Further, the voltage impressed onto charge wire 4a' is selected so as to be of same polarity as that which prevails at static charger 2 or more precisely to be positive.

(i) First charging step:

Operations are similar to those which were adopted in the foregoing two operation modes.

(ii) Exposure step:

Operations are same as those which were adopted in the foregoing two operation modes. At this stage, the latent images formed on the drum surface 1, as shown in FIG. 10 at (a), are similar to those which were shown in FIG. 8 at (a).

Figure 9:
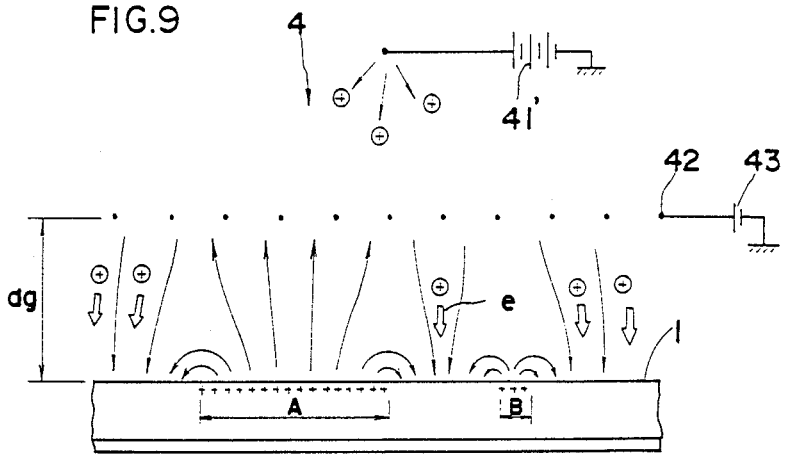
FIG. 9 is a similar view to FIG. 7, showing, however, the case of reverse peripheral outline image formation mode.

(iii) Second charging step:

The drum surface 1 on which positive latent images have been formed a set forth in the foregoing, is subjected to a recharging step by applying a charge of same polarity with that of the said latent images, under the action of scorotron charger 4. At this stage, grid 42' is impressed with a voltage of +500 V from source 43. The voltage impressed on scorotron charger 4 is of same polarity as adopted in the foregoing first charging step. The voltage as impressed on the grid 42 is somewhat lower than the surface potential, +600 V, at latent image areas A;B and is of the same polarity with that adopted in the first charging step. In addition, the voltage impressed upon grid 42 is selected to be sufficient higher than the surface potential, +100 V. of at the non-image portions. This measure has been adopted to let the surface potential at non-image areas rise in the second charging step sufficiently relative to the former surface potential. Between drum surface 1 and grid 42, electric lines of force are generated, as schematically shown in FIG. 9 by elongated arrows. Positive ions emanated from charge wire 4a are subjected to carrying drive force along said electric lines. Electric lines of force which drive these positive ions in proximity of grid 42 towards drum surface 1 are those which are generated exclusively within such range in correspondence to non-image parts of image areas A;B, however, being devoid of outer peripheral zones extending along the peripheral outlines of said image areas. Therefore, the positive ions will impinge, as shown by double-lined arrows e, exclusively upon non-image of imaged areas A;B, however, being devoid of said outer peripheral zones A';B', thereby potentials at the ion-impinged portions being subjected to recharging and to rise up in its potential level substantially equal to grid voltage Vg or so.

Figure 10A:
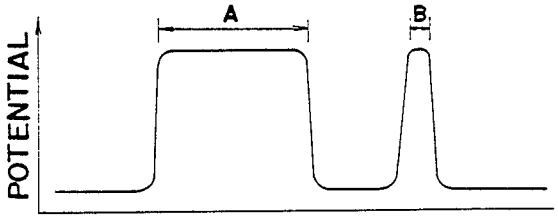
FIG. 10 is a graph showing potential levels of static latent images appearing at several operational step and in the case of the second embodiment of the invention.
Figure 10B:
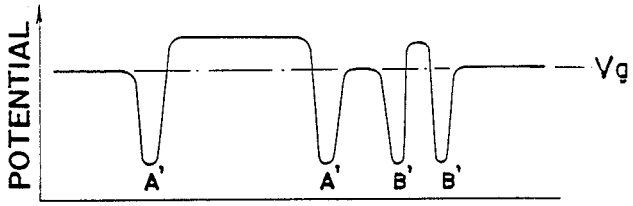
Figure 10C:
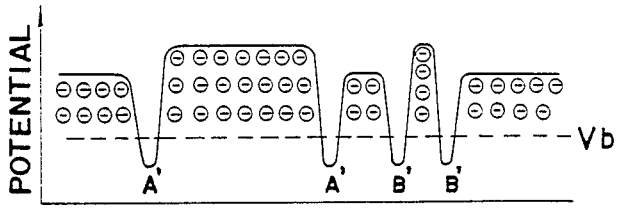

When further describing in terms of surface potentials on drum surface 1, as shown in FIG. 10 at (b), the surface potential at image areas A;B remain as at high potential level substantially of +600 V which corresponds to initial surface potential, while the potential at outside peripheral zones A'; B' extending along peripheral outlines of imaged areas A;B, remains as low potential portion of a certain constant width and amounting substantially to +100 V. Further, the potentials at non-image areas devoid of outside zones A';B' extending along the peripheral outlines of the image areas will rise up substantially to the level of grid voltage Vg. More specifically, it will be rise up substantially to +500 V or so, under application of a voltage +5.5 kV to scorotron charger 41' and of a voltage +500 V to grid voltage source 43.

As a result, in other words, the peripheral outlines of imaged areas A;B have been converted during the second charging step into corresponding negative latent images.

(iv) Developing step:

The formed negative images of peripheral outlines of imaged areas during the second charging step are then subjected to a developing step under the action of developing unit 5. At this stage, developing sleeve 51 is impressed with a developing bias voltage of +300 V.

For the purpose of attaining positive and reliable deposit of the toner not only the non-image portions where the surface potential has been considerably risen up during the second charging step, but also imaged portions of latent image areas, the developing bias voltage Vb has been set to be sufficiently lower than that at the potential-risen, non-lmaged areas, say +500 V, and the polarity has been selected to be same as that adopted in the first charging step.

In this way, the negatively charged insulative toner deposits onto the high potential areas other than outside peripheral zones A';B' extending along peripheral outlines of image areas A;B on drum surface 1, thus negative and reversed peripheral outlines formed and tonered being provided in "from-outside embroidering manner" so to speak, and indeed, through the way of normal developing step. These toner images are then transferred to a copy paper 10 through positive discharge at tansfer charger 6 and subjected to a fixing processing at a fixer, not shown, to provide as a whole a copy image.

Since the insulative toner used in the first and second embodiments has a sufficiently high electric resistance, common papers can be used in the image transfer step with better quality. This feature may be utilized also in the next following third embodiment with similar results.

In the foregoing first and second embodiments, insulative toner is used of non-magnetic nature. However, instead thereof, magnetic one may also be used if desired. Further, in the peripheral image forming mode, if wanted, developing sleeve 51 may be impressed with such a developing bias voltage as of somewhat lower voltage level than the surface potential at latent image areas where the potential has been lowered in the second charging step. Still further, a developing bias superposed with an alternating voltage may be used.

THIRD EMBODIMENT

In the present third embodiment of the invention, the reverse peripheral outline image forming mode has been modified to a certain degree.

In this embodiment, relationship between the voltage as applied onto grid 42 of scorotron charger 4 and developing bias voltage as applied onto developing sleeve 51 has been so preselected that the surface potential at non-image area subjected to recharging at second charging step is somewhat higher than a sudden riser potential appearing at starting point of the developing step. More specifically, the grid voltage source 43 is set to a voltage of +330 V, while developing bias source is set to +300 V. Other operating conditions are same as those adopted in the foregoing first embodiment.

It will thus be seen that the first charging step and the exposure step in the present embodiment are executed similarly as in the reverse peripheral outline image forming mode of the foregoing first embodiment. The second charging step is carried out, however, under such a modified condition as application of +5.5 kV to scorotron charger's voltage source 41 and of +330 V to grid voltage source 43.

Formation mode of electric lines of force generated between drum surface 1 and grid 42 in the second charging step is substantially similar as shown in FIG. 9. Positive ions emanated from the charge wire impinge exclusively upon non-image areas, being however devoid of outer peripheral zones A';B' extending along peripheral outlines of image areas A;B on the drum surface, as shown by double line arrows e in FIG. 9. As a result, the ion-impinged areas are subjected to a recharging up to substantially the level of grid voltage Vg of +300 V in this case.

Figure 11A:
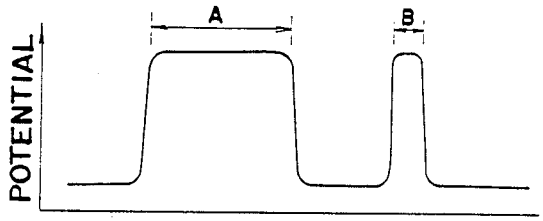
FIG. 11 is a similar view to FIG. 10, illustrating, however, the case of the third embodiment of the invention.
Figure 11B:
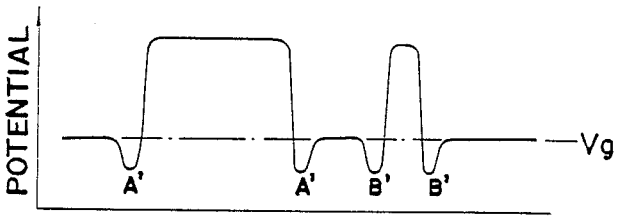
Figure 11C:
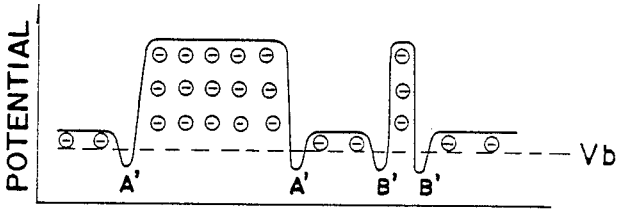

Further describing in terms of surface potentials on the drum 1, as shown in FIG. 11 at (b), the surface potentials at image portions A;B remain as a high potential level substantially of +600 V which corresponds to the initial surface potential, while the potential at the outside peripheral zones A';B' extending along peripheral outlines of image areas A:B remain in the form of high potential regions, each having a certain constant width, and the potential at non-image areas devoid of said outside peripheral zones will rise up substantially to grid voltage Vg, thus remaining as medium potential areas amounting to +330 V or so.

In the next developing step, a standard developing operation is carried out with use of negatively charged insulative toner and the developing sleeve 51 which is impressed with a developing bias voltage of +300 V from the source 53. The developing bias voltage Vb is so selected to be somewhat lower than grid voltage Vg: +330 V and to have same polarity employed in the foregoing first charging step.

As the results of the foregoing processing, negatively charged toner has deposited at the high potential portions on the drum 1 which are naturally image areas A;B, at a sufficient concentration, while it deposits on non-image areas representing a medium potential, and with a light concentration. More specifically, reverse and negative peripheral outline images are formed through a normal developing step in such a mode that the peripheral outline zones A';B' alongside of the peripheral image outlines are made white and blank and the background areas are slightly colored.

In the present invention, the static latent images formed in the exposure step are, indeed, subjected to an additional processing so to speak, in the second charging step, thereby otherwise liably occurring ill effects caused by fluctuation in exposing light quantity being positively removed off. As the results of our experiments with varied light quantities either in a certain experiment with such a considerable increase of the exposure light so as to reduce the potential at non-image areas to +70 V or so, or with such a considerable reduction for providing a potential level thereat to be +150 V (in these cases the potential level at image areas being commonly being +600 V), the corresponding portions to documentary background areas were evenly and lightly colored and there was no appreciable change of color concentration. In the following, the reason of the foregoing optimum experimental results and the relationship between grid voltage Vg and bias voltage Vb will be set forth specifically.

In the case of the present third embodiment, scorotron charger 4, the surface potential at the non-image areas is elevated in the second charging step with use of scorotron charger 4 to a certain constant level. The raised, potential is substantially equal to the grid voltage Vg. Even with considerable vibration in the surface potential at non-image areas between +70–+150 V or so, as in the present third embodiment or as in our experiments mentioned above, the surface potential at the non-image areas appearing in the developing step after execution of the second charging step has risen up to the level of +330 V which is substantially equal to the grid voltage Vg. As a result, a thin layer of toner is deposited thereon and thus, the color concentration at the non-image background areas is substantially constant without showing any appreciable change thereof.

Next, the relationship between grid voltage Vg and developing bias voltage Vb will be set forth.

In the case of normal magnetic brushing development system, the developing characteristics will rise up from the surface potential at the photosensitive drum which is equal to developing bias voltage Vb.

When the regular scorotron charger is used in the second charging step, the surface potential of the drum is subjected to recharging up to substantially the grid voltage Vg, and therefore, if it is intended to color in light tones such areas as corresponding to non-image background portions of documentary images, it will be sufficient to set the grid voltage Vg somewhat higher than the developing bias voltage Vb. By selecting this difference at a proper value, the color concentration at the background areas evenly and lightly colored can be varied as desired.

However, in the case of certain other developing system, the developing characteristics may frequently rise up from a different voltage level other than developing bias voltage Vb and further depending upon the operating conditions at scorotron charger, the recharging operation may frequently bring about the surface potential to become somewhat higher or lower level than the grid voltage.

Thus, as for the using values of grid voltage as well as developing bias voltage, they must be properly set depending upon the aforementioned conditions, and it is better to let the developing characteristics rise up from such potential as being somewhat lower than surface potential at the background subjected to recharging under the action of scorotron charger.

In the foregoing embodiments so far shown and described, positive documents are utilized. However, even with use of negative documents, it is possible to make change over operation to select and operate any desired one among standard mode, peripheral outline formation mode and reverse peripheral outline formation mode. In this case, the grid is impressed with such a voltage which is not only lower than the surface potential residing at non-image areas of latent images corresponding to the negative document, but also higher than the surface potential at the image areas. In such a case where the voltage impressed upon scorotron charger is of direct current one, operation control is carried out in such a way that impression of charge of same polarity with that prevailing at the charger is employed in the peripheral outline image forming mode, or static charge of reverse polarity to that prevailing at the static charger is impressed in the case of reverse peripheral outline image forming mode.

Although the present invention has been fully described by way of examples with reference to the various changes and modifications will be apparent to those skilled in the art. Therefore, unless otherwise such changes and modifications depart from the scope of the present invention, they should be construed as being included therein.

What is claimed is:

1. A copying apparatus comprising:

first charging means for charging an electrostatic latent image bearing member to a predetermined potential;

exposing means for exposing an original document to the charged electrostatic latent image bearing member to form an electrostatic latent image;

second charging means for recharging the electrostatic latent image formed on the electrostatic latent image bearing member, said second charging means having a grid;

developing means for developing the electrostatic latent image formed on the electrostatic latent image bearing member with an insulative toner having a polarity opposite to the polarity of the first charging means;

mode designating means for designating a first mode wherein a toner is deposited onto the latent image exclusive of the outline portion to visualize;

control means for operating the second charging means when the first mode is designated by the mode designating means.

2. A copying apparatus as claimed in claim 1 wherein the grid is applied with the voltage which is lower than the surface potential at the image portion of the latent image and higher than the surface potential at the non-image portion of the latent image.

3. A copying apparatus as claimed in claim 2 wherein the second charging means is applied with an alternating current voltage.

4. A copying apparatus as claimed in claim 2 wherein the second charging means is applied with a direct current voltage.

5. A copying apparatus comprising:

first charging means for charging an electrostatic latent image bearing member to a predetermined potential;

exposing means for exposing an original document to the charged electrostatic latent image bearing member to form an electrostatic latent image;

second charging means for recharging the electrostatic latent image formed on the electrostatic latent image bearing member, said second charging means having a grid;

developing means for developing the electrostatic latent image formed on the electrostatic latent image bearing member with an insulative toner having a polarity opposite to the polarity of the first charging means;

first mode designating means for designating a first mode wherein a toner is deposited onto the latent image exclusive of the outline portion to visualize;

second mode designating means for designating a second mode wherein a toner is only deposited onto the outline portion of the latent image to visualize;

first control means for operating the second charging means when the first mode or second mode is designated by the mode designating means;

second control means for controlling the voltage applied to the grid to be variable.

6. A copying apparatus as claimed in claim 5 wherein the second control means, when having designated the first mode, for controlling to apply the voltage to the grid, said voltage being slightly lower than the surface potential at the image portion of the latent image and sufficiently higher than the surface potential at the non-image portion of the latent image in order that only the outline portion has the lower potential portion.

7. A copying apparatus as claimed in claim 5 wherein the second control means, when having designated the second mode, for controlling to apply the voltage to the grid, said voltage being sufficiently lower than the surface potential at the image portion of the latent image and slightly lower than the surface potential at the non-image portion of the latent image in order that only the outline portion has the higher potential portion.

8. A copying apparatus as claimed in claim 5 wherein the second charging means is applied with an alternating current voltage.

9. A copying apparatus as claimed in claim 5 wherein the second charging means is applied with a direct current voltage.

10. A copying apparatus as claimed in claim 9 wherein the polarity of the voltage applied to the second charging means is changeable to have a same polarity as that of the first charging means when the first mode is designated, and to have an opposite polarity to that of the first charging means when the second mode is designated.

11. A copying apparatus capable of forming an outline image comprising:

first charging means for charging an electrostatic latent image bearing member to a predetermined potential;

exposing means for exposing an original document to the charged electrostatic latent image bearing member to form an electrostatic latent image;

second charging means for recharging the electrostatic latent image formed on the electrostatic latent image bearing member, said second charging means having a grid which is applied with an alternating current voltage;

developing means for developing the electrostatic latent image formed on the electrostatic latent image bearing member with an insulative toner having a polarity opposite to the polarity of the first charging means, said developing means having a bias electrode;

first mode designating means for designating a first mode wherein a toner is deposited onto the latent image exclusive of the outline portion to visualize;

second mode designating means for designating a second mode wherein a toner is only deposited onto the outline portion of the latent image to visualize;

first control means for operating the second charging means when the first mode or second mode is designated by the mode designating means;

second control means for controlling the voltage applied to the grid of the second charging means to be variable; and third control means for controlling the voltage applied to the bias electrode of the developing means to be variable.

12. A copying apparatus as claimed in claim 11 wherein the second control means, when having designated the first mode, for controlling to apply the voltage to the grid, said voltage being slightly lower than the surface potential at the image portion of the latent image and sufficiently higher than the surface potential at the non-image portion of the latent image in order that only the outline portion has the lower potential portion.

13. A copying apparatus as claimed in claim 11 wherein the second control means, when having designated the second mode, for controlling to apply the voltage to the grid, said voltage being sufficiently lower than the surface potential at the image portion of the latent image and slightly lower than the surface potential at the non-image portion of the latent image in order that only the outline portion has the higher potential portion.

14. A copying apparatus as claimed in claim 11 wherein the third control means, when having designated the first mode, for controlling the voltage applied to the bias electrode to set at a first value or second value so as to conrol the density at the non-image portion of the latent image.

15. A copying apparatus as claimed in claim 11 wherein the voltage applied to the bias electrode of the developing means is set higher than the voltage of the grid when the second mode is designated.

* * * * *